United States Patent [19]

Emonet

[11] 4,446,773

[45] May 8, 1984

[54] COMPRESSED AIR DISTRIBUTOR FOR A RECIPROCATING CONCRETE BREAKING TYPE MACHINE

[75] Inventor: Henri Emonet, Loire, France

[73] Assignee: Maco-Meuden, France

[21] Appl. No.: 406,815

[22] Filed: Aug. 10, 1982

Related U.S. Application Data

[63] Continuation of Ser. No. 207,823, Nov. 7, 1980, abandoned, which is a continuation of Ser. No. 943,724, Sep. 19, 1978, abandoned.

[51] Int. Cl.[3] ..... F01L 25/04

[52] U.S. Cl. ..... 91/317; 91/325

[58] Field of Search ..... 91/299, 317, 325; 137/533.17

[56] References Cited

U.S. PATENT DOCUMENTS

| | | | |
|---|---|---|---|
| 1,771,181 | 7/1930 | Lear | 91/317 |
| 1,965,264 | 7/1934 | Smith, Jr. | 91/299 |
| 2,637,300 | 5/1953 | Van Sittert | 91/317 |
| 3,154,096 | 10/1964 | Bell | 137/533.17 |
| 3,245,483 | 4/1966 | Etzkorn | 91/317 |

FOREIGN PATENT DOCUMENTS

| | | | |
|---|---|---|---|
| 379665 | 8/1923 | Fed. Rep. of Germany | 91/317 |
| 675836 | 11/1929 | France | 91/317 |
| 878048 | 9/1942 | France | 91/317 |
| 605043 | 9/1978 | Switzerland | 91/325 |

*Primary Examiner*—Paul E. Maslousky

*Attorney, Agent, or Firm*—Remy J. VanOphem

[57] ABSTRACT

A compressed air distribution system to control the movement of a reciprocating concrete breaking jackhammer wherein a plastic distributor made of two individual pieces is provided with a seat on each piece for a pellet moving therebetween is disclosed. The efficiency of the distributor is significantly increased as a result of the reduction of shock loading on the seats as well as the virtual elimination of vibration as a result of rebounding of the pellet. These improvements significantly increase machine performance and lowers the manufacturing cost.

1 Claim, 5 Drawing Figures

COMPRESSED AIR DISTRIBUTOR FOR A RECIPROCATING CONCRETE BREAKING TYPE MACHINE

This is a continuation of application Ser. No. 207,823, filed Nov. 17, 1980, now abandoned, which is itself a continuation of application Ser. No. 943,724, filed Sept. 19, 1978, now abandoned.

BACKGROUND OF THE INVENTION

The present invention concerns a compressed air distribution or similar system to control the movement of a reciprocating machine, of the concrete breaking type, and including a distributor made in two pieces, each one defining a contact surface for a pellet moving between the two pieces or seats.

Such distributors are used, for instance, in concrete-breaking jack-hammers. The moving pellet is made of relatively thick steel or alloy disk of about three millimeters or more. The distributor body, formed by the seats, is also made of metal. The leading systems are impaired by the following disadvantages:

- A significant inertia of the oscillating pellet, so that a metal construction is justified for the seats, considering the violence of the shocks to which they are subjected.
- At the end of each stroke, the shock of the pellet occurs between two metal pieces, which mostly results in rebounds of the pellet; the machine performance is limited whereas the maximal air consumption is higher.
- The operating noise and manufacturing costs are high.

The only low inertia-type pellets known are thin and drilled. They do not fit in this type of distributor.

The purpose of the present invention is to avoid these disadvantages and produce a distributor that includes a moving pellet which is both solid and thin, and interfacing with a seat made of a plastic material so as to lower the cost of the distributor and improve its performance at the same time.

SUMMARY OF THE INVENTION

Therefore, the system invented features a body made of a rigid, shock-resistant, plastic material, which offers some shock-absorbing ability, along with a moving pellet which is made of a thin, solid, metal disk with low inertia. The combination of both elements allowing for an improved machine performance and lowering the distributor manufacturing cost at the same time.

Thus, the distributor efficiency is increased, whereas its air consumption is significantly lowered, because of the elimination of the free pellet rebounding effect between the two separate seats. Eliminating the free pellet rebounding effect is made possible by the shock absorbing ability of the plastic material used.

For example, if a steel pellet of about 0.8 mm is used, it is possible to lower the air consumption by 20% or more. The seats of the distributor are made of a shock-resistant, plastic material, for instance a polyamide, commercially known as "nylon" or even "Rilsan." The seats can also be made of a plastic material reinforced with fiberglass for instance. A polyacetal material may also be used.

Each face of the pellet is subjected to the pneumatical pressure produced from a circular chamber provided in the back of each respective seat. Both circular chambers being continuously fed by compressed air through an inlet chamber surrounding the distributor.

The distributor body may include two pieces or seats between which the pellet is located, these two pieces being molded, for instance, which lowers the cost of the machine. Each piece includes a central, axial bore which opens in front of one of the pellet faces on the one hand, and communicates with the cylinder housing the alternating displacement of the piston head on the other hand.

According to one type of construction, the compressed air-feeding system for the circular chambers is provided by radial holes that are drilled during the molding of the two components of the distributor body in so-called "mechanical" molds.

According to another version, the feeding is obtained through a system of grooves or slots, both body components or pieces being then molded with simple molds, although it is still possible to increase the bottom thickness of the piece made of a plastic material, and thereby increase its rigidity.

BRIEF DESCRIPTION OF THE DRAWINGS

The attached drawing, given as a non-limiting example, is designed to provide a better understanding of the invention.

DETAILED DESCRIPTION OF THE PREFERRED EMBODIMENT

Figure 1:
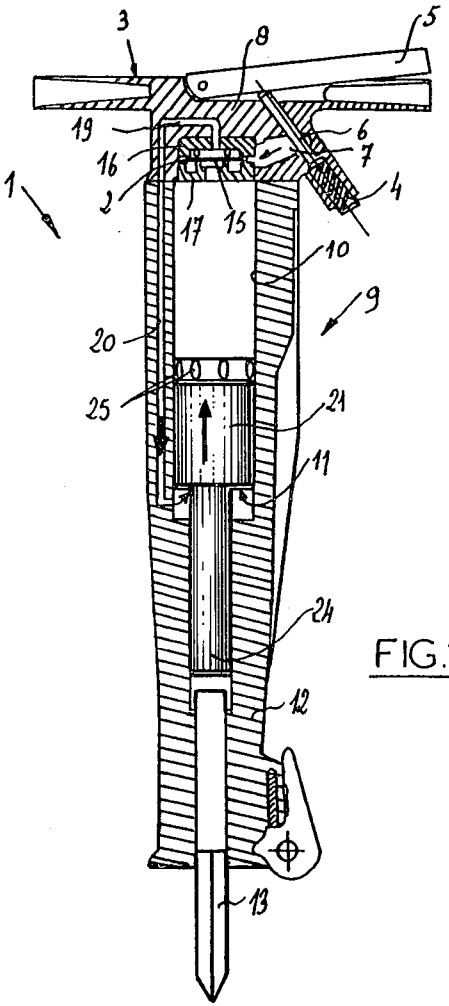
FIG. 1 is an overall sectional view of a machine equipped with an air distributor according to the invention.

FIG. 1 illustrates a section showing the general structure of a concrete breaking jack-hammer 1 equipped with a distributor 2. This jack-hammer includes a control handle 3, under which a compressed air inlet nozzle 4 is located. The opening of this nozzle is controlled by a lever 5 which can push a rod 6 in shutting position by counteracting on its spring return mechanism. The compressed air penetrates into an inlet chamber 7 surrounding the distributor 2.

The distributor is mounted inside a hammer control head 8. This head is mounted behind a body 9 whose rear part defines a cylinder 10 whereas its front part forms a barrel 12 which is formed with a polygonal, for instance hexagonal, axial bore. A piston 11 slides inside the cylinder. The shank of a tool 13 moves and oscillates along the barrel bore.

Figure 3:
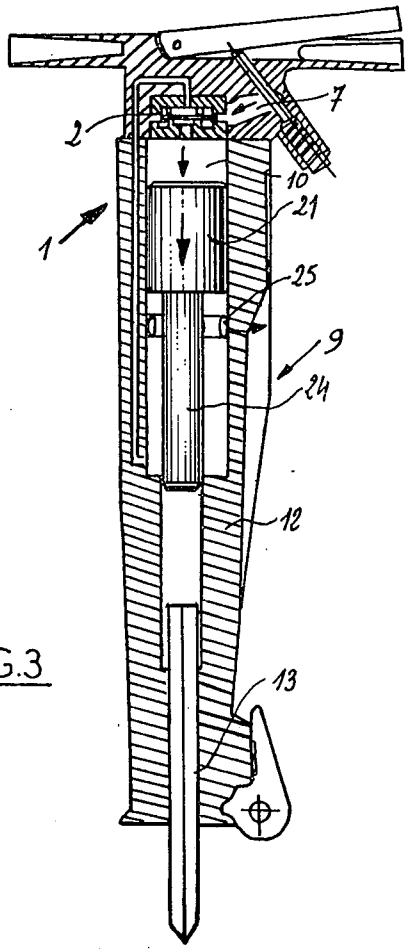
FIG. 3 is a view similar to FIG. 1, which also shows the initial part of the piston stroke.
Figure 2:
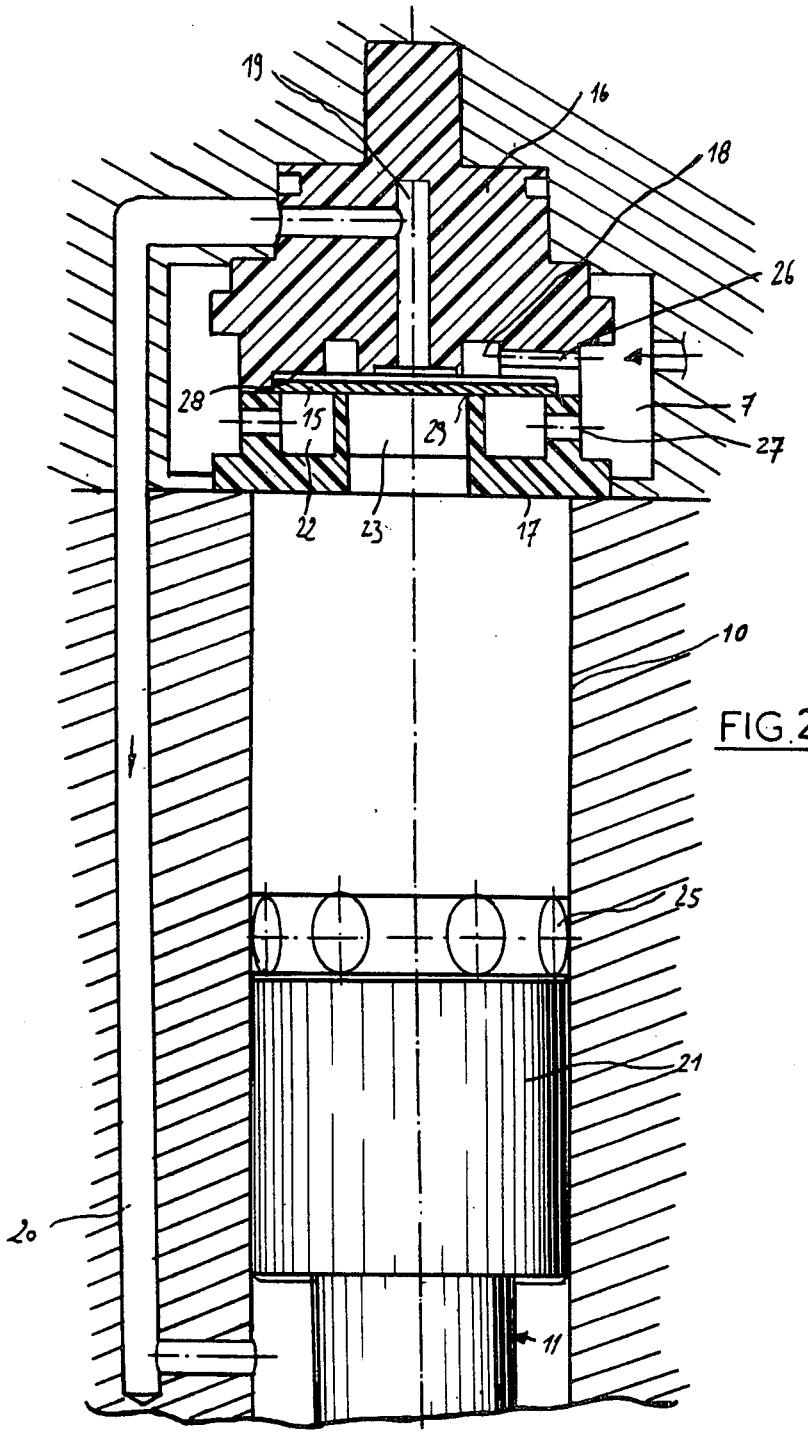
FIG. 2 is a detailed sectional view illustrating the distributor structure.

This device operates according to a classical and familiar principle. The compressed air coming from the chamber 7 goes alternatively:

(a) through the inlet hole 26 into the upper circular chamber 18 of the upper or front seat 16 and in the central seat 19 where it is sent, through the tubing 20, in front of the piston head 21 which is thus "moved up" that is, pushed toward the back of the device; this return stroke occurs when the pellet 15 of the distributor 2 is resting against its lower or back seat 17 as shown in FIG. 2;

(b) as the pellet is pressed against its upper or front seat 16, the air is sent, through the inlet hole 27, into the circular chamber 22 and the bore 23 of the lower or back seat 17, toward the back of the piston head 21 which, then, moves toward the front, the end of its rod 24 striking the shank of the tool 13 as shown in FIGS. 1, 2 and 3.

It is known that the kinetics stored by the piston results from the difference of pressure existing between the front and rear faces of this piston. The alternating movement is provided by exhaust vents 25 which are alternatively open (to allow for the piston's displacement) and then shut by the side walls of the piston (which induces the unsticking and displacement of the pellet 15 which goes from one seat to the other).

As stated earlier, the performance of the popular system is limited since the high frequency shocks between the oscillating pellet and the seats occur between two metal surfaces.

The present distributor 2 essentially includes the following combination:

The seats 16 and 17 are made of a shock-resistant plastic material and they interface with a thin pellet 15, made of steel or another similar metal or alloy;

The shock absorbing ability of the "plastic" seats and the low inertia of the mobile pellet minimizes the shock and rebound effects of the pellet striking either seat.

FIG. 2 shows a detailed view of the seats 16 and 17 and of the pellet 15, which constitute the distributor. Each seat is molded, for instance, in molds equipped with detachable broaches. During the molding of the plastic material, these broaches provide radial holes such as 26 or 27. The dies are designed to provide the circular chambers 18 and 22, the central bores 19 and 23 and finally the contact surfaces or end faces such as 28 and 29. The stripping operation only requires the removal of the broaches from the mold.

With only one operation, it is thus possible to obtain the distributor seats, whereas the usual techniques (metal seats) require a long, sophisticated and expensive machining process.

The use of molded, plastic material, such as Nylon, Rilsan or polyacetal seats is made possible by the low inertia of the pellet. Although the popular metal pellets can be from three to five millimeters thick, the invention requires a significantly thinner pellet (0.8 to 1.2 mm).

This combination offers the following advantages:

significantly lower cost;

lower operating noise;

elimination of the pellet's rebounds, which lowers the power consumption;

generally improved performance since the striking power of the piston on the tool, in particular, is not reduced although the air consumption is considerably lowered by roughly 20%.

Needless to say, in particularly severe working conditions, the plastic material may be reinforced to offer better shock resistance (fiberglass reinforced nylon for instance).

Figure 5:
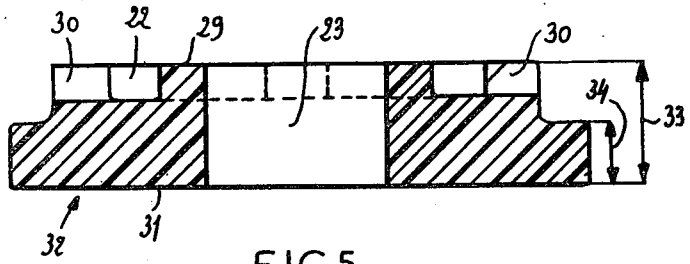
FIG. 5 is a sectional view along lines V—V of FIG. 4.
Figure 4:
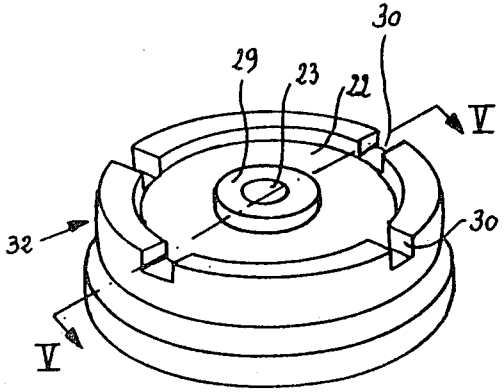
FIG. 4 is a view of a possible version of the seats.

FIGS. 4 and 5 show another type of construction for the seats. The holes 26 and 27 (shown in FIG. 2) are replaced by slots 30 which are made in simplified molds (no detachable broaches). Actually, these slots are open on one face of the molded piece. Furthermore, the number of slots may be relatively high, depending on the desired air flow. Finally, these slots being located near the contact surface of the pellet, the bottom 31 of the seat 32 may include, for a same overall height 33, a thickness 34 significantly greater than in the case of radial holes. This increased thickness improves the rigidity of the part made of plastic material.

What I claim is:

1. In combination with a reciprocating compressed air jack-hammer machine, for breaking concrete, of the type having a housing including a portion defining a central passage with one end and an opposite end, a tool mounted in the opposite end of said central passage and a piston disposed adjacent said tool; said jack-hammer machine further having a compressed air distribution system including an inlet chamber and passage means for ducting the compressed air alternatively to the front of said piston and to the back of the piston to reciprocate said piston in said central passage in said housing, said piston further striking said tool when the compressed air is ducted to reciprocate said piston toward said tool, the improvement comprising:

a distributor body mounted adjacent to said one end of said central passage of said housing, said distributor body further comprising:

a front seat member having a first contact surface and portions defining a central hole formed in said first contact surface, said central hole further being connected to said central passage for flow communication therebetween, said front seat member formed of shock resistant plastic;

a back seat member mounted adjacent to said front seat member, said back seat member having a second contact surface adjacent to said first contact surface, said back seat member being formed of shock resistant plastic;

a circular solid pellet member mounted for oscillation between said first contact surface of said front seat member and said second contact surface of said back seat member, said circular solid pellet member defining a low inertia disk with a thickness 1.2 mm or less, said circular solid pellet member further defining a first chamber on one side of said circular solid pellet member and a second chamber on the opposite side of said circular solid pellet member, said first chamber being in fluid communication with said central hole when said circular solid pellet member is contiguous to said second contact surface and spaced away from said first contact surface; and first inlet passage means, disposed in said front seat member for selectively connecting said inlet chamber to said central passage, said first inlet passage means further comprising at least one inlet hole spaced a predetermined distance from said first contact surface, said at least one inlet hole connecting said inlet chamber with said first chamber for fluid communication therebetween and thereby selectively interconnecting said first inlet passage means with said central passage when said circular solid pellet member is contiguous with said second contact surface of said back seat member; said communication between said inlet chamber and said central passage being terminated when said circular solid pellet member is contiguous said first contact surface of said front seat member;

second inlet passage means, disposed in said back seat member, for connecting said second chamber with said inlet chamber and said central passage when said circular solid pellet member is contiguous to said first contact surface and spaced away from said second contact surface; and exhaust passage means located in said central passage of said housing in spaced relationship to said distributor body such that compressed air entering said inlet chamber is communicated through said first inlet passage means to said first chamber and to said central passage to move said circular solid pellet member towards said second contact surface of said back seat member and to further move said piston from a predetermined point in a front direction uncovering said exhaust passage means, said compressed air simultaneously being communicated through said second inlet passage means to said second chamber and to said central passage to the front of said piston such that when said piston uncovers said exhaust passage means and said circular solid pellet member moves against said first contact surface of said front seat member, said compressed air at the front of said piston returning said piston in a backward direction to its predetermined point of beginning to again uncover said exhaust passage means, said piston thereby reciprocating to strike said tool.

* * * * *